US007581468B2

(12) United States Patent
Wu

(10) Patent No.: US 7,581,468 B2
(45) Date of Patent: Sep. 1, 2009

(54) CONTROL DEVICE FOR ANGLE ADJUSTABLE HAND TOOL

(75) Inventor: Arthur Wu, Taichung County (TW)

(73) Assignee: Proxene Tools Co., Ltd., Taichung County (TW)

( * ) Notice: Subject to any disclaimer, the term of this patent is extended or adjusted under 35 U.S.C. 154(b) by 10 days.

(21) Appl. No.: 11/984,853

(22) Filed: Nov. 23, 2007

(65) Prior Publication Data

US 2009/0133542 A1 May 28, 2009

(51) Int. Cl.
*B25B 23/16* (2006.01)

(52) U.S. Cl. ..... 81/177.9; 81/177.85

(58) Field of Classification Search ..... 81/177.7–177.9; 16/900

See application file for complete search history.

(56) References Cited

U.S. PATENT DOCUMENTS 1,205,149 A * 11/1916 Bovee ..... 81/177.9
5,211,143 A * 5/1993 Fontichiaro et al. ..... 123/90.18
6,971,292 B2 * 12/2005 Hu ..... 81/177.8
2003/0188608 A1 * 10/2003 Hsien ..... 81/177.8
2005/0103168 A1 * 5/2005 Wei ..... 81/177.7

* cited by examiner

*Primary Examiner*—D. S Meislin
(74) *Attorney, Agent, or Firm*—Banger Shia

(57) ABSTRACT

An angle adjustable hand tool includes a driving head pivotably connected to a handle and a pawl is received in the handle and removably engaged with the teeth in the driving head. A button is engaged with a hole in the handle and perpendicularly communicates with the hole in which the pawl is received. The button includes a recess and a second contact surface connects the recess. When the button is pushed, the pawl is located in the recess of the button so that the driving head can be pivoted relative to the handle. The driving head is set when the pawl is engaged with the teeth of the driving head.

13 Claims, 13 Drawing Sheets

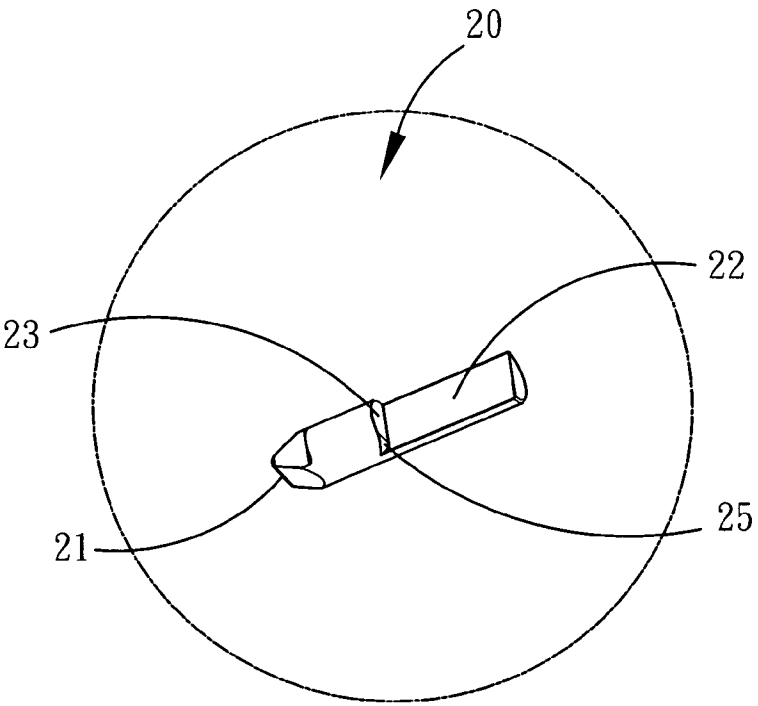
FIG.1—2
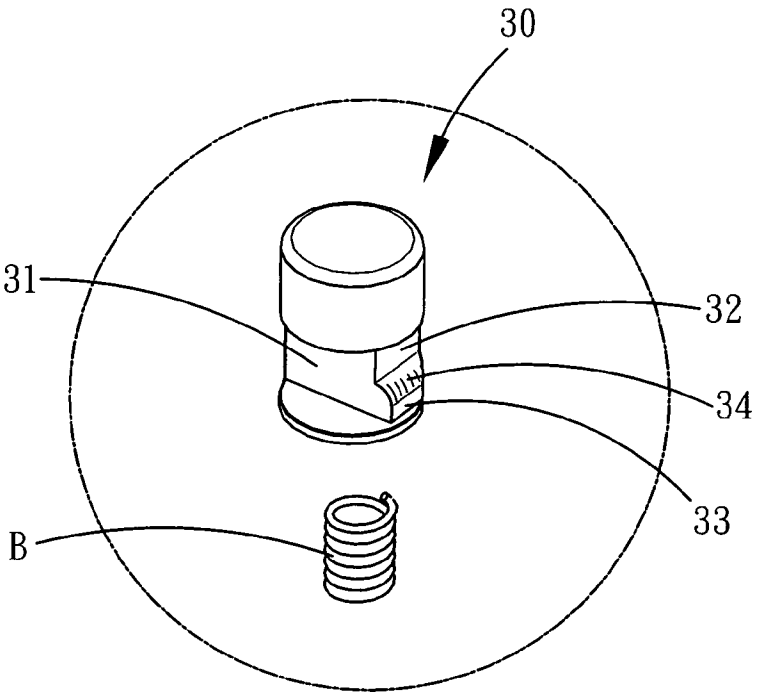
FIG.1—1

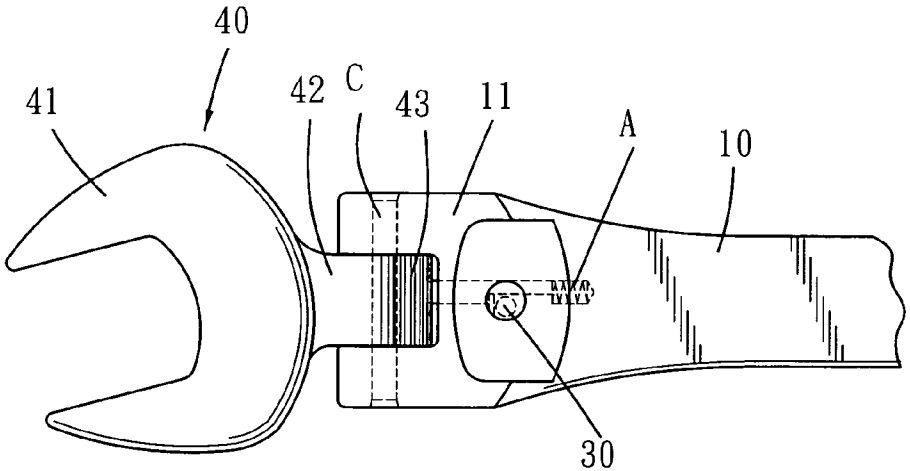
FIG.2
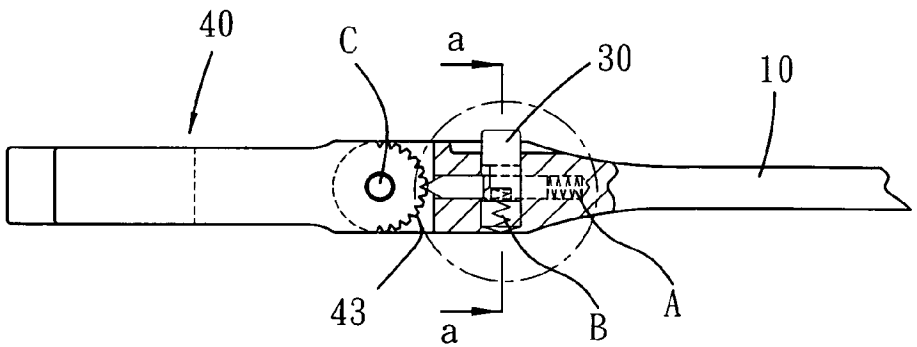
FIG.3
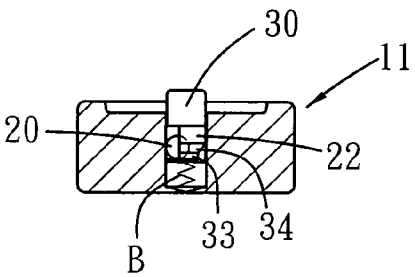
FIG.3—1

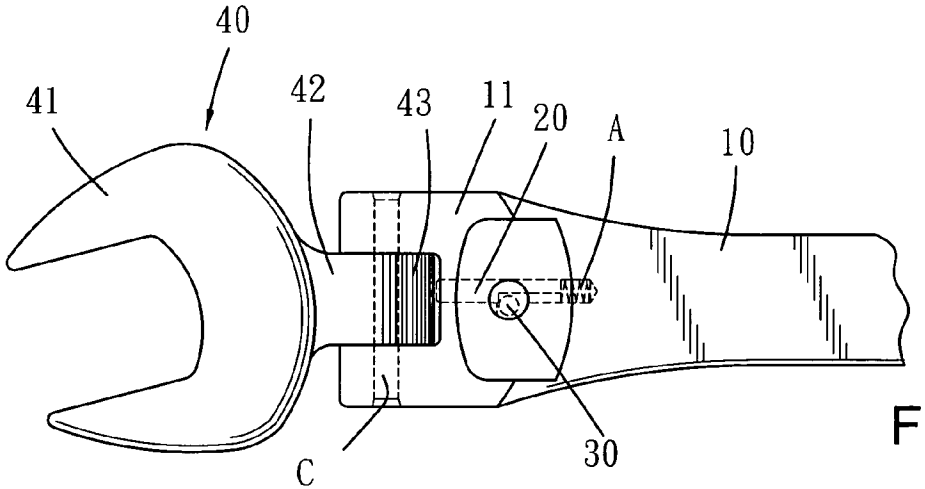
FIG.5
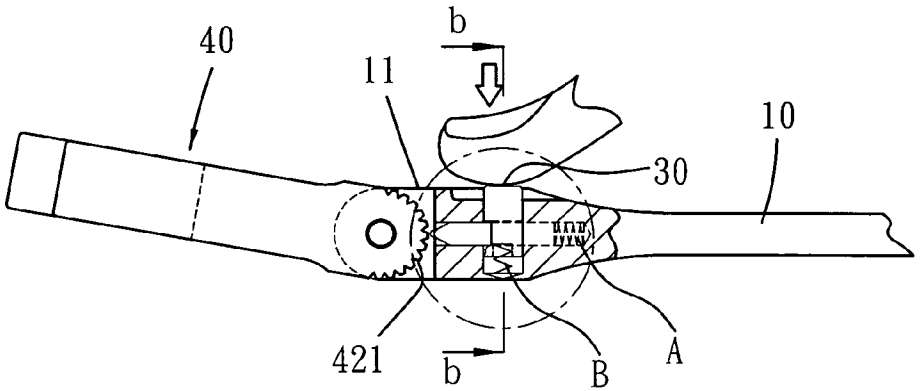
FIG.6
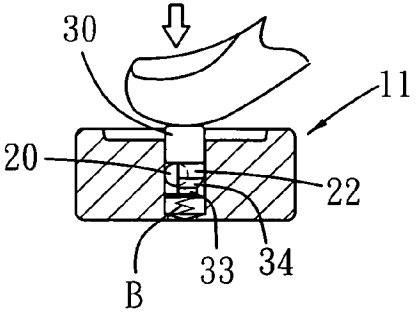
FIG.6—1

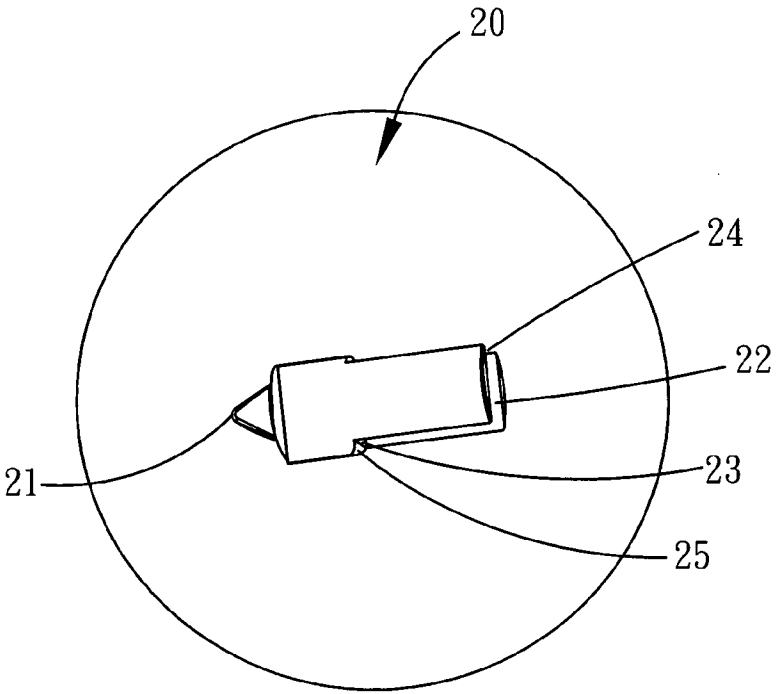
FIG.8—2
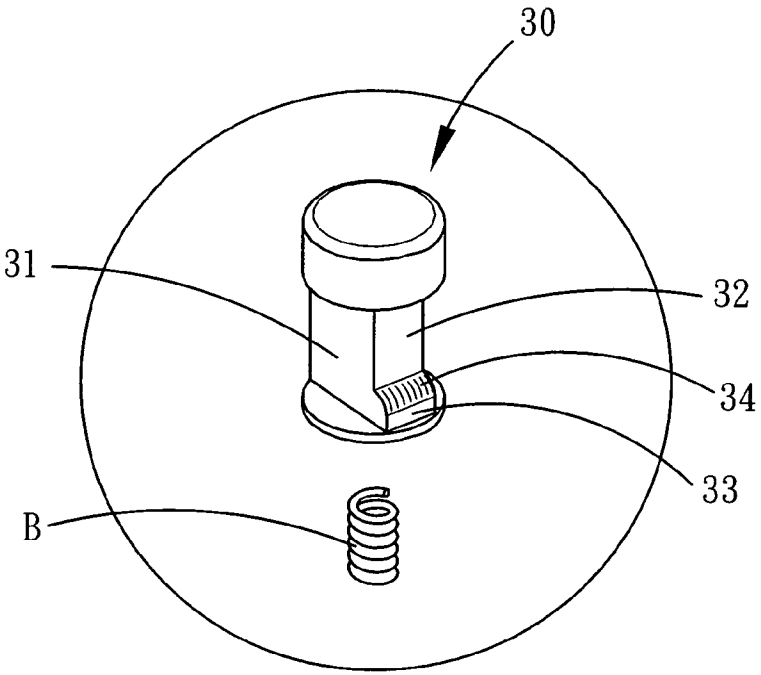
FIG.8—1

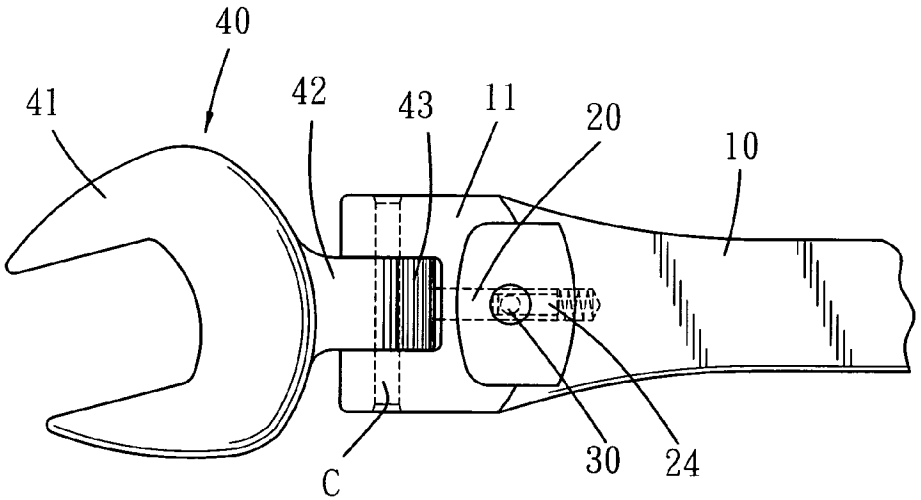
FIG.9
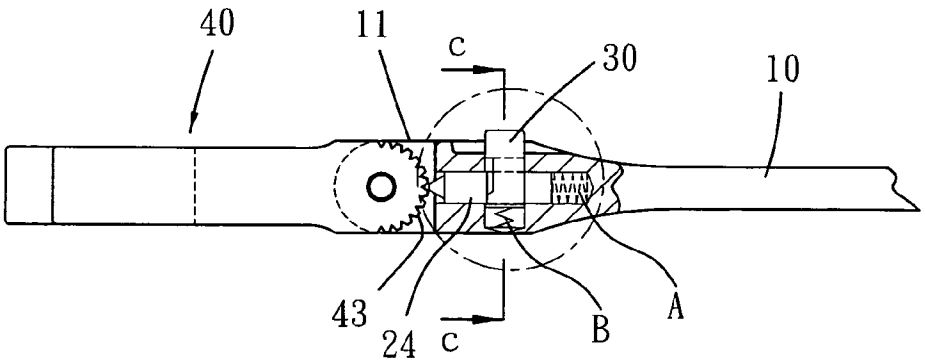
FIG.10
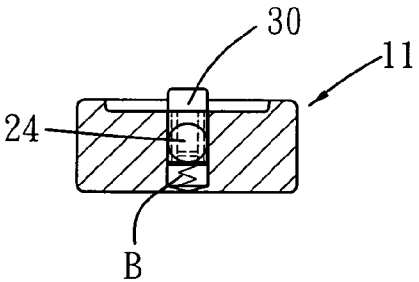
FIG.10—1

CONTROL DEVICE FOR ANGLE ADJUSTABLE HAND TOOL

BACKGROUND OF THE INVENTION (1) Field of the Invention

The present invention relates to a control device for angle adjustable hand tool.

(2) Description of the Prior Art

A conventional angle adjustable hand tool is disclosed in U.S. Pat. No. 7,131,356 which includes a spring and a positioning plate at the front end of the adjusting member and the positioning plate supports the driving head when the adjusting member is disengaged from the teeth of the driving head such that the driving head does not fall suddenly. However, extra parts are required and the assembly processes becomes complicated and difficult.

Another conventional angle adjustable hand tool is disclosed in U.S. Pat. No. 7,131,346 which includes a button and a hole is defined in the center of the button so as to accommodate a second connection member. This requires a larger area for the button. When a small scale of hand tool is manufactured, the area button becomes a difficult part to be manufactured and a small area of button might be broken when drilling the hole at its center.

The present invention intends to provide a control device for an angle adjustable hand tool which includes a simple and compact structure and effectively control the driving head during the process for setting its angle.

SUMMARY OF THE INVENTION

The present invention relates to an angle adjustable hand tool which comprises a handle having a first connection end and a first hole is defined axially in the first connection end so as to receive a spring and a pawl therein. A second hole is defined in the first connection end and perpendicularly communicates with the first hole so as to receive another spring a button therein. A driving head includes a driving member and a second connection end which is pivotably connected to the first connection end and includes a first engagement end. The pawl includes a second engagement end which is removably engaged with the first engagement end. At least one first flat surface is defined in a shank of the pawl and a first contact surface is connected the first flat surface. The button includes at least one second flat surface which is matched with the first flat surface of the pawl. A recess is defined in the button and located substantially perpendicular to the at least one second flat surface. A second contact surface is connected the recess.

When the button is pushed, the second contact surface is disengaged from the first contact surface and the pawl is then located in the recess of the button so that the driving head can be pivoted and the first engagement end of the driving head moves over the second engagement end of the pawl to adjust the angle of the driving head relative to the handle. The second engagement end of the pawl is engaged with the first engagement end again when releasing the button.

The primary object of the present invention is to provide a control device for adjusting the driving head relative to the handle, the driving head is kept being engaged with a pawl when pivoting to a new angle. The control device is easily to be assembled and operated.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 1-1 shows the button and the spring for biasing the button;

FIG. 1-2 shows the pawl and the spring for biasing the pawl;

FIG. 2 shows that the pawl is engaged with the teeth of the driving head;

FIG. 3 shows a partial cross sectional view of the control device of the hand tool;

FIG. 3-1 is a cross sectional view taken along line a-a in FIG. 3;

FIG. 5 is a plain view to show the button is pushed and pawl is not positioned by the button;

FIG. 6 is a side partial cross sectional view to show that the button is pushed and the driving head is pivoted;

FIG. 6-1 is a cross sectional view taken along line b-b in FIG. 6;

FIG. 8-1 shows the button and the spring for biasing the button of the embodiment in FIG. 8;

FIG. 8-2 shows the pawl and the spring for biasing the pawl of the embodiment in FIG. 8;

FIG. 9 is a plain view to show the button is pushed and pawl is positioned by the button for the embodiment of FIG. 8;

FIG. 10 is a side partial cross sectional view to show that the button is not pushed and the pawl is engaged with the driving head for the embodiment of FIG. 8;

FIG. 10-1 is a cross sectional view taken along line c-c in FIG. 10;

DETAILED DESCRIPTION OF THE PREFERRED EMBODIMENTS

Figure 15:
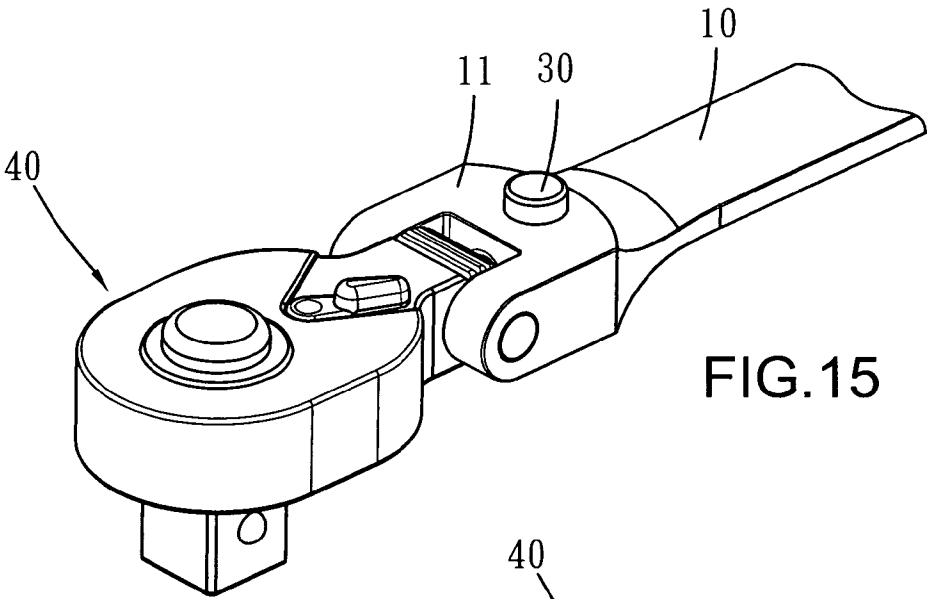
FIG. 15 shows that the driving member is a ratchet driving member.
Figure 16:
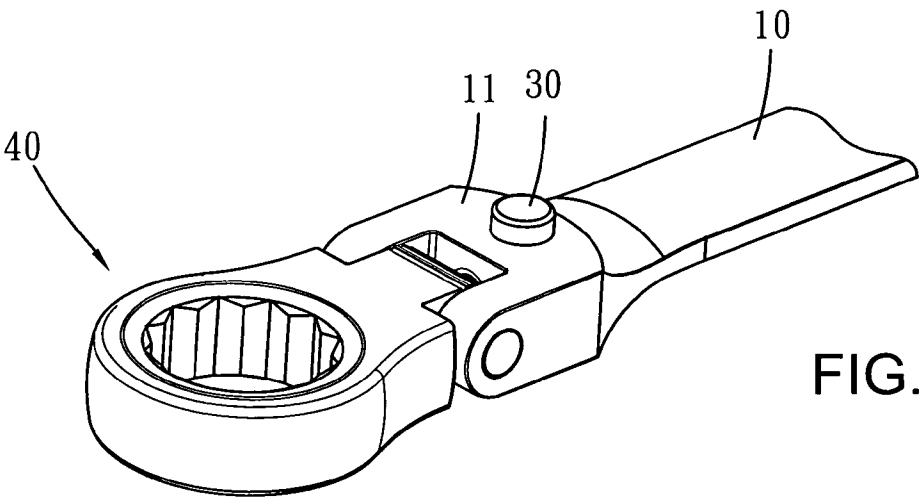
FIG. 16 shows that the driving member is a box end.

Referring to FIGS. 1 to 7, the angle adjustable hand tool of the present invention comprises a handle 10 having a first connection end 11 and a first hole 114 is defined axially in the first connection end 11. The first connection end 11 includes two protrusions 112 and a space 111 is defined between the two protrusions 112. A second hole 115 is defined in the first connection end 11 and perpendicularly communicates with the first hole 114. Two respective springs "A", "B" are received in the first and second holes 114, 115 respectively. A driving head 40 includes a driving member 41 such as an open end as show in FIG. 1 or a ratchet driving member as shown in FIG. 15 or a box end as shown in FIG. 16. A second connection end 42 which is pivotably connected between the two protrusions 112 of the first connection end 11 by extending a pin "C" through the two respective first pin holes 113 in the two protrusions 112 and the second pin hole 44 defined through the second connection end 42 of the driving head 40. A first engagement end 43 is fixed on one end of the second connection end 42 and includes teeth defined therein. The teeth are shaped to include a V-shaped space or U-shaped space defined between the teeth of the first engagement end 43.

A pawl 20 is movably received in the first hole 114 and biased by the spring "A", the pawl 20 includes a second engagement end 21 which is a wedge end and removably engaged with the teeth of the first engagement end 43. A first flat surface 22 is defined in a shank of the pawl 20 and a first contact surface 23 is connected the first flat surface 22. A first guide surface 25 is connected the first contact surface 23 of the pawl 20.

Figure 1:
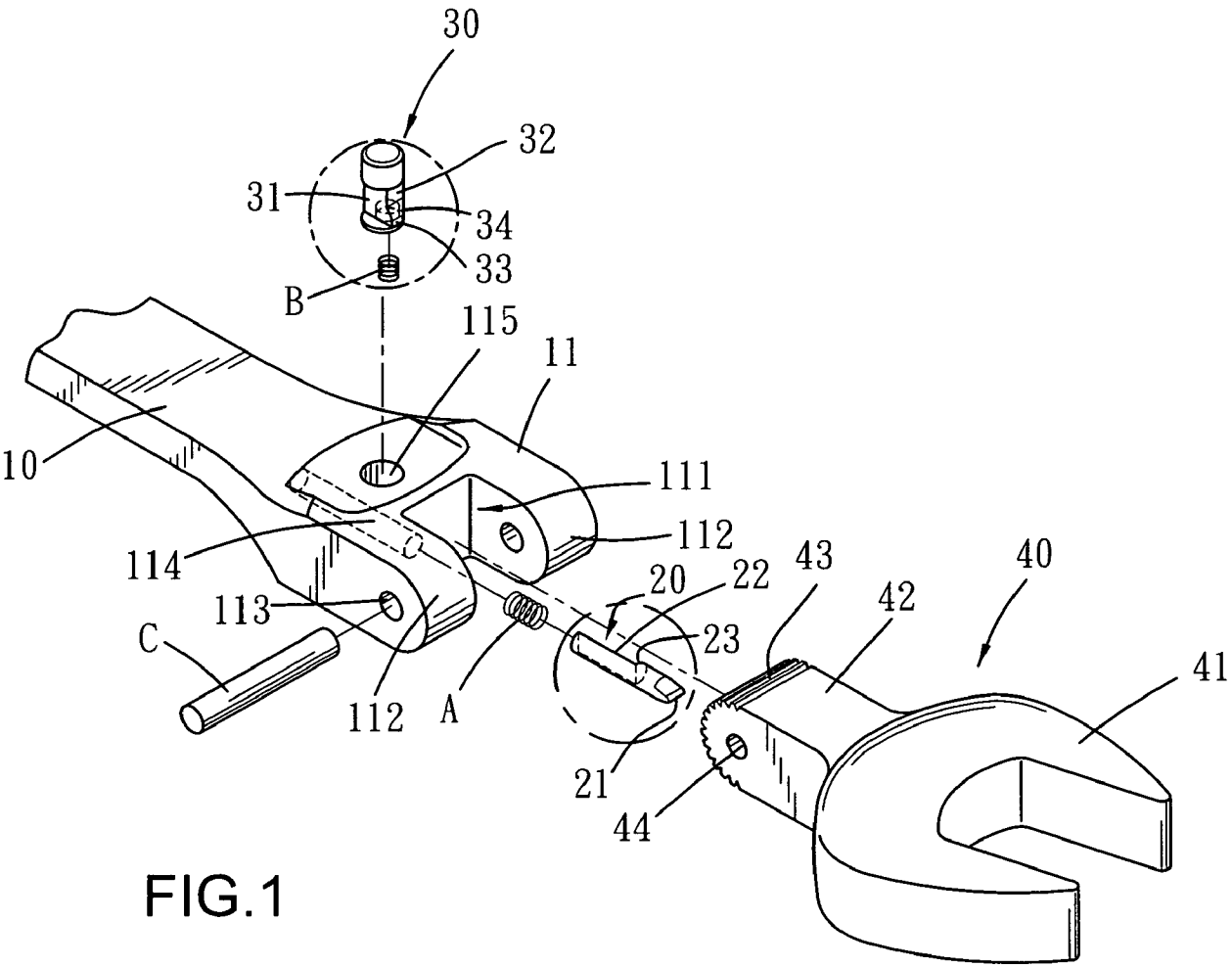
FIG. 1 is an exploded view to show the control device of the angle adjustable hand tool of the present invention.
Figure 4:
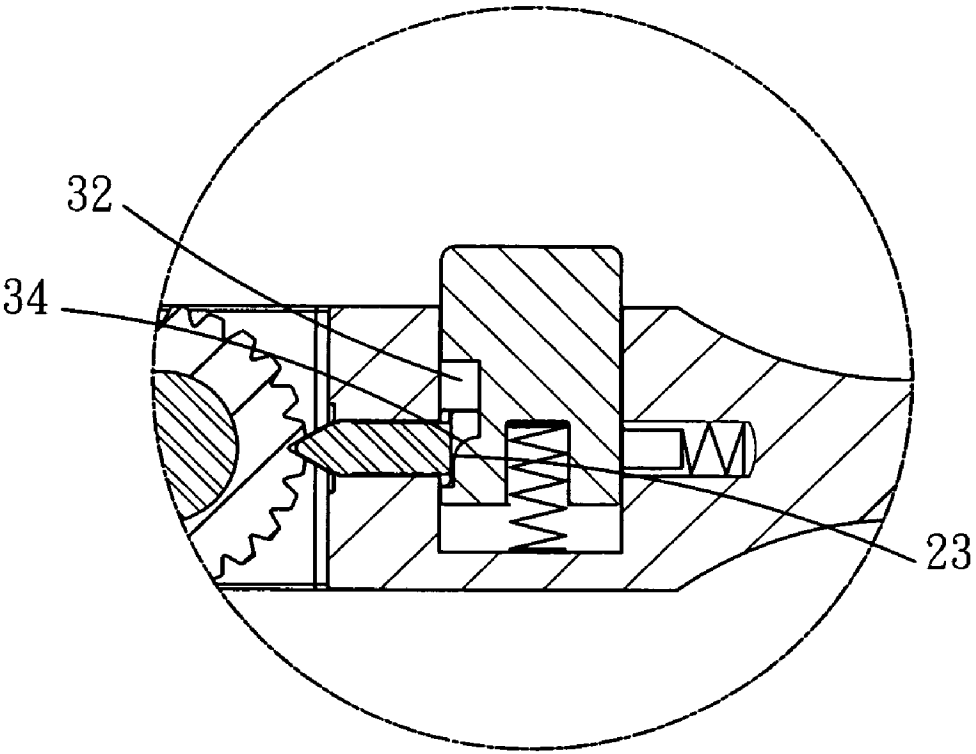
FIG. 4 is an enlarged cross sectional view to show that the pawl is engaged with the teeth of the driving head.
Figure 7:
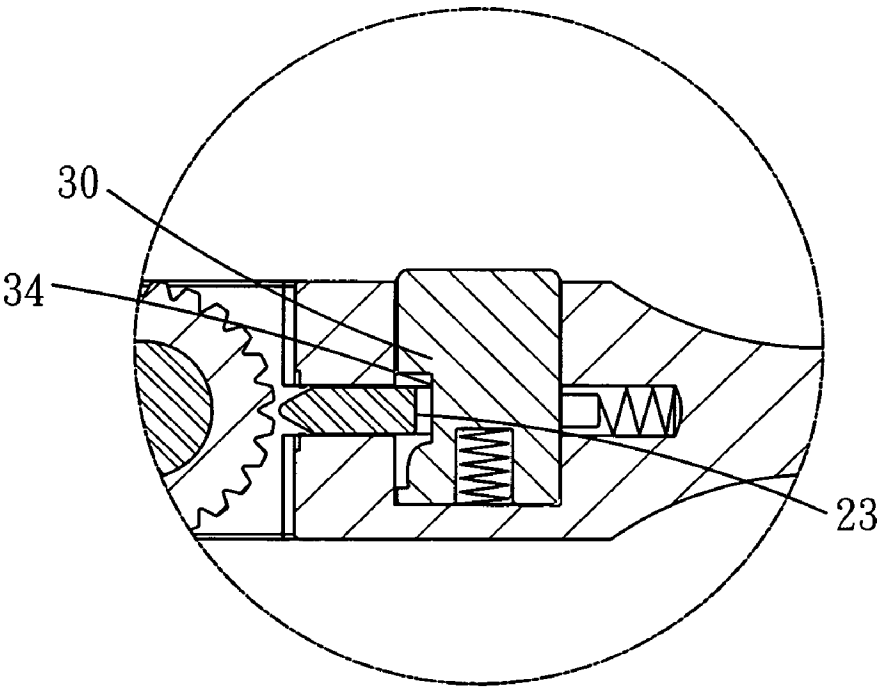
FIG. 7 is an enlarged cross sectional view to show the pawl is located in the recess of the button when the button is pushed.
Figure 8:
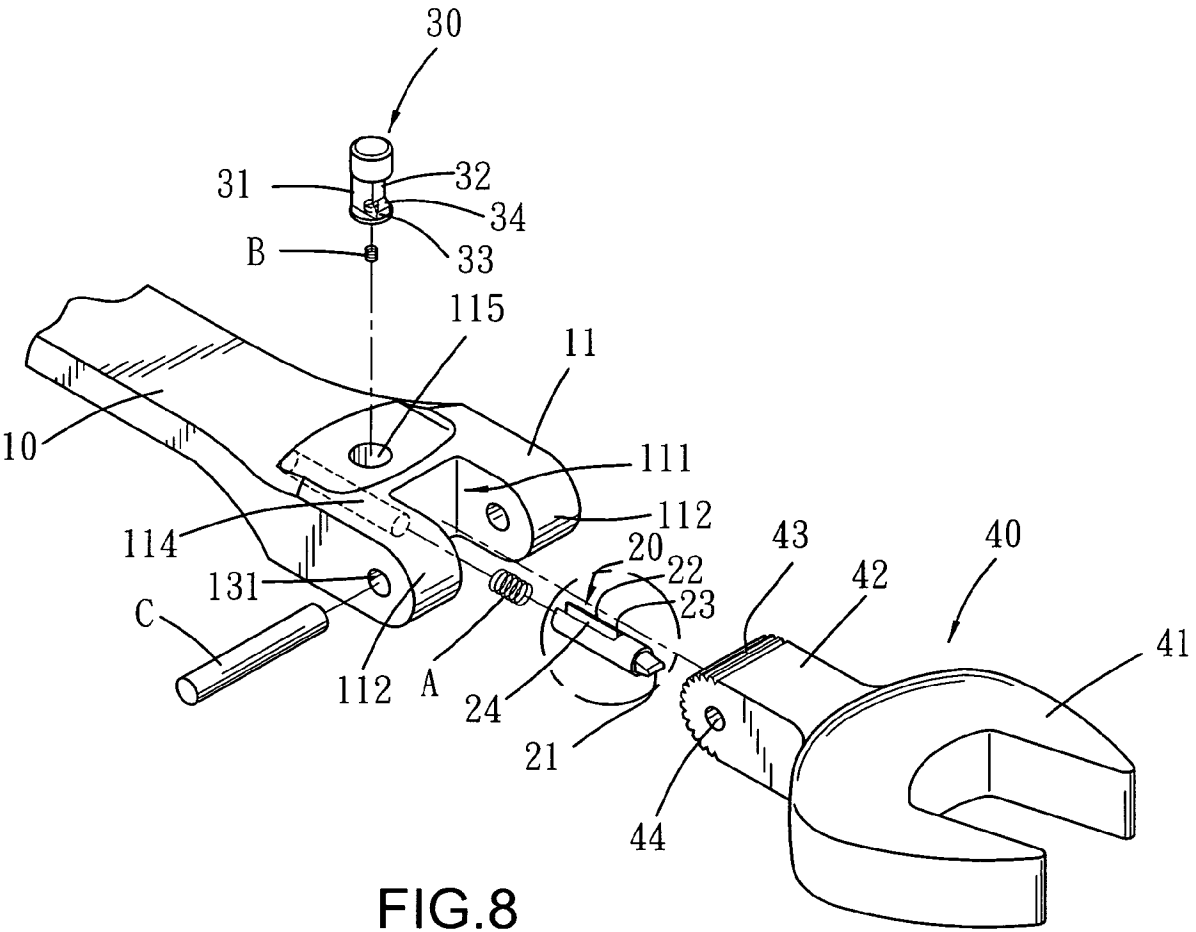
FIG. 8 is an exploded view to show another embodiment of the control device of the present invention.
Figure 11:
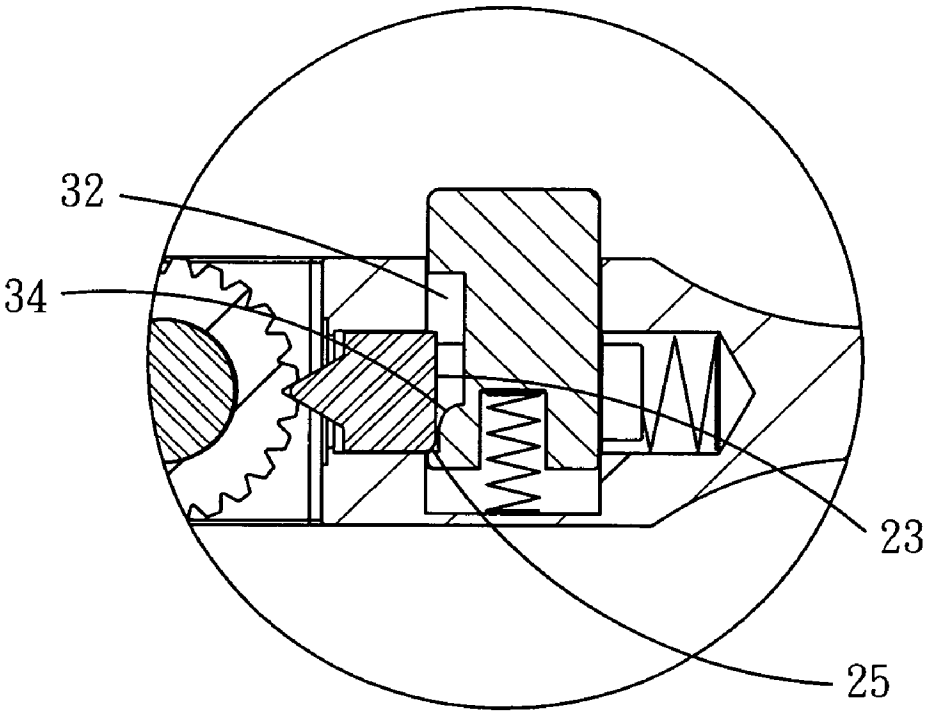
FIG. 11 is a cross sectional view to show that the pawl is engaged with the teeth of the driving head.
Figure 12:
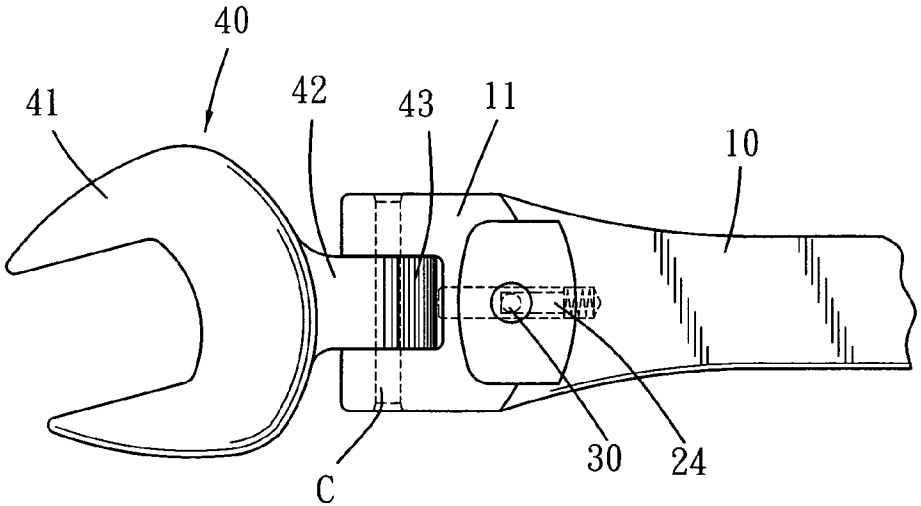
FIG. 12 is a plain view to show the button is pushed and pawl is not positioned by the button for the embodiment of FIG. 8.
Figure 13:
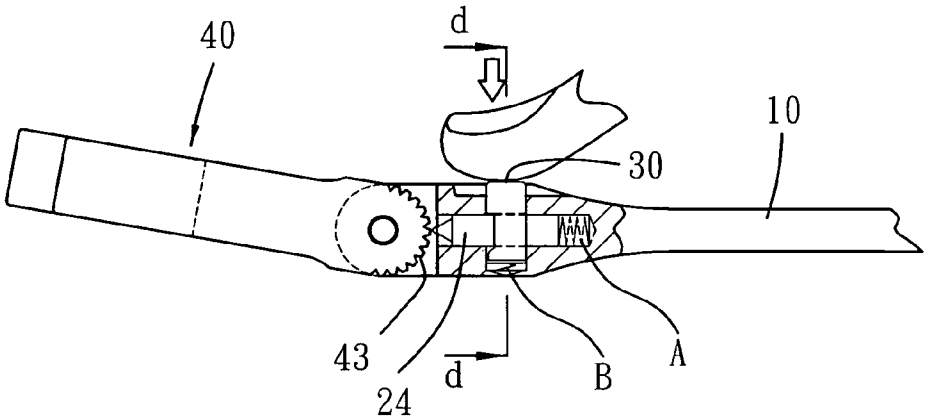
FIG. 13 is a side partial cross sectional view to show that the button is pushed and the driving head is pivoted for the embodiment of FIG. 8.
Figure 14:
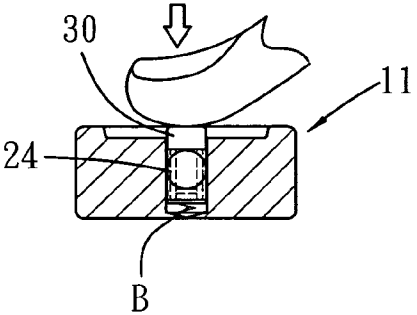
FIG. 14 is a cross sectional view taken along line d-d in FIG. 13.

A button 30 is engaged with the second hole 115 and biased by the spring "B". The button 30 includes a second flat surface 31 which is matched with the first flat surface 22 of the pawl 20. A recess 32 is defined in the button 30 and located substantially perpendicular to the second flat surface 31. A second guide surface 34 is connected between the recess 32 and a second contact surface 33. As shown in FIG. 4, the pawl 20 is pushed by the second contact surface 33 and the spring "B" so that the second engagement end 21 is engaged with the teeth of the second connection end 42 of the driving head 40.

As shown in FIGS. 5, 6, 6-1 and 7, when the button 30 is pushed by the user, the button 30 is lowered and the second contact surface 33 is disengaged from the first contact surface 23, the pawl 20 is then located in the recess 32 of the button 30. The pawl 20 is not longer positioned by the second contact surface 33 so that the driving head 40 can be pivoted and the first engagement end 43 of the driving head 40 moves over the second engagement end 21 of the pawl 20 to adjust the angle of the driving head 40 relative to the handle 10. When releasing the button 30, the second engagement end 21 of the pawl 20 is engaged with the first engagement end 43 again and the pawl 20 is positioned by the button 30.

FIGS. 8-14 show another embodiment of the control device of the present invention, wherein the pawl 20 includes a slot 24 defined axially therein so as to define two first flat surfaces 22 in two facing insides of the slot 24. Correspondingly, the button 30 includes two second flat surfaces 31 and the recess 32 is located at two respective ends of the two second flat surfaces 31. The shank of the button 30 is movably engaged with the slot 24 and the two second flat surfaces 31 are engaged with the first flat surfaces 22. By this way, the button 30 cannot rotate. The second contact surface 33 is connected the recess 32 via the second guide surface 34 which is a curved and convex surface. The operation processes are the same as the first embodiment of the control device.

Figure 17:
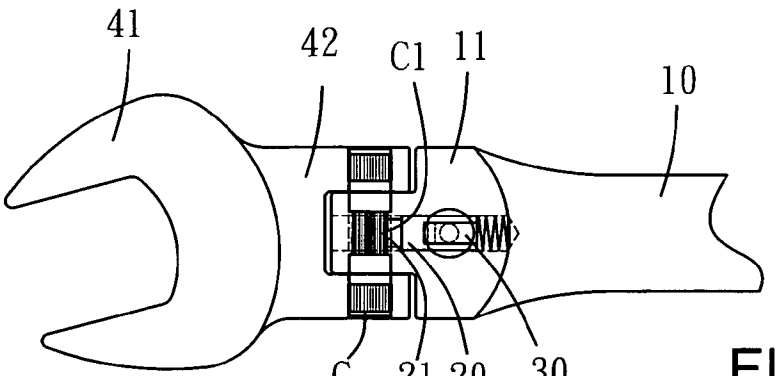
FIG. 17 is a plain view to show yet another embodiment of the hand tool.
Figure 18:
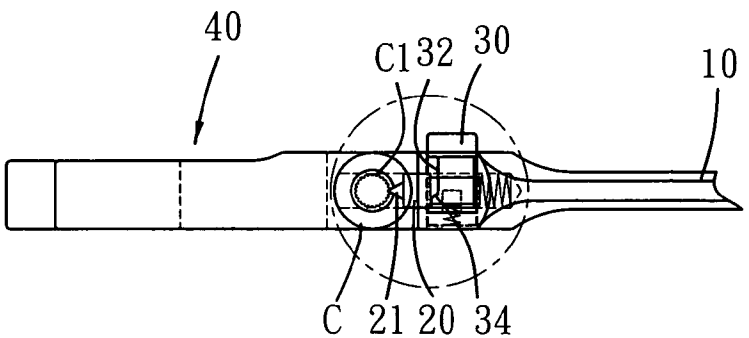
FIG. 18 is a side view of the control device and the hand tool in FIG. 17.
Figure 19:
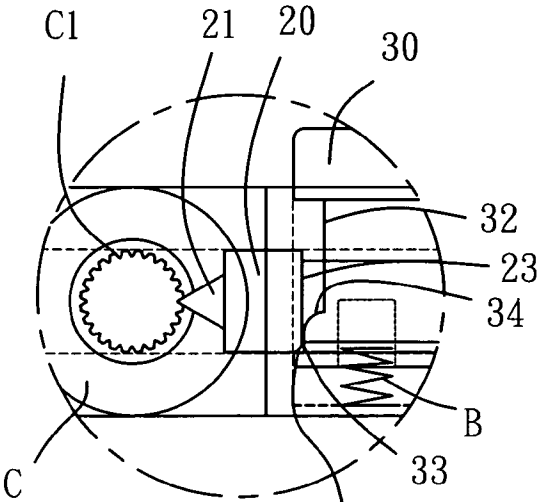
FIG. 19 shows that the pawl is engaged with the teeth in the pin for the hand tool in FIG. 17.

FIGS. 17 to 19 show that the first connection end 11 is fixed on one end of the handle 10 and the second connection end 42 of the driving head 40 includes two protrusions with a space defined therebetween so that the first connection end 11 of the handle 10 is pivotably connected between the two protrusions of the second connection end 42 by the pin "C". The pawl 20 is movably inserted in the first hole in the first connection end 11 and the button 30 is perpendicularly engaged with the pawl 20 in the first connection end 11. The pin "C" includes a first engagement end "C1" which includes teeth and located in the space between the two protrusions. The second engaged end 21 of the pawl 20 is engaged with the first engagement end "C1".

When the button 30 is pushed, the second contact surface 33 is disengaged from the first contact surface 23 of the pawl 20 and the pawl 20 is then located in the recess 32 of the button 30. The driving head 40 can be pivoted and the first engagement end C1 of the pin "C" moves over the second engagement end 21 of the pawl 20 to adjust the angle of the driving head 40 relative to the handle 10. The second engagement end 21 of the pawl 20 is engaged with the first engagement end "C1" again when releasing the button 30.

The pawl 20 and the button 30 are directly in contact with each other and the pawl 20 is activated when the button 30 is pushed so that the number of parts can be minimized and the driving head 40 does not drop suddenly when the button 30 is pushed.

While we have shown and described the embodiment in accordance with the present invention, it should be clear to those skilled in the art that further embodiments may be made without departing from the scope of the present invention.

What is claimed is:

1. An angle adjustable hand tool comprising:

a handle having a first connection end and a first hole defined axially in the first connection end, a second hole defined in the first connection end and perpendicularly communicating with the first hole, two respective springs received in the first and second holes respectively;

a driving head having a driving member and a second connection end which is pivotably connected to the first connection end and includes a first engagement end having teeth defined therein;

a pawl movably received in the first hole and having a second engagement end which is removably engaged with the teeth of the first engagement end, at least one first flat surface defined in a shank of the pawl and a first contact surface connected to the first flat surface;

a button engaged with the second hole and including at least one second flat surface which is matched with the first flat surface of the pawl, a recess defined in the button and located substantially perpendicular to the at least one second flat surface, a second contact surface connected to the recess, when the button is pushed, the second contact surface being disengaged from the first contact surface and the pawl is then located in the recess of the button so that the driving head is pivoted and the first engagement end of the driving head moves over the second engagement end of the pawl to adjust the angle of the driving head relative to the handle, the second engagement end of the pawl is engaged with the first engagement end again when releasing the button;

wherein a second guide surface is connected between the recess and the second contact surface;

wherein the second guide surface is a curved and convex surface.

2. The hand tool as claimed in claim 1, wherein the first connection end of the handle includes at least one first pin hole and the second connection end of the driving head includes at least one second pin hole, a pin extends through the at least one first pin hole and at least one second pin hole.

3. The hand tool as claimed in claim 1, wherein the first connection end includes two protrusions and a space is defined between the two protrusions, the second connection end of the driving head is pivotably received in the space.

4. The hand tool as claimed in claim 1, wherein the pawl includes a slot defined axially therein so as to define two first flat surfaces.

5. The hand tool as claimed in claim 4, the button includes two second flat surfaces and the recess is located at two respective ends of the two second flat surfaces, the second contact surface is connected to the recess.

6. The hand tool as claimed in claim 1, wherein a first guide surface is connected to the first contact surface of the pawl.

7. The hand tool as claimed in claim 1, wherein a V-shaped space is defined between the teeth of the first engagement end.

8. The hand tool as claimed in claim 1, wherein a U-shaped space is defined between the teeth of the first engagement end.

9. The hand tool as claimed in claim 1, wherein the driving member is an open end.

10. The hand tool as claimed in claim 1, wherein the driving member is a box end.

11. An angle adjustable hand tool comprising:

a handle having a first connection end and a first hole defined axially in the first connection end, a second hole defined in the first connection end and perpendicularly communicating with the first hole, two respective springs received in the first and second holes respectively;

a driving head having a driving member and a second connection end which is pivotably connected to the first connection end;

a pin including a first engagement end having teeth defined thereon;

a pawl movably received in the first hole and having a second engagement end which is removably engaged with the teeth of the first engagement end, at least one first flat surface defined in a shank of the pawl and a first contact surface connected to the first flat surface;

a button engaged with the second hole and including at least one second flat surface which is matched with the first flat surface of the pawl, a recess defined in the button and located substantially perpendicular to the at least one second flat surface, a second contact surface connected to the recess, when the button is pushed, the second contact surface being disengaged from the first contact surface and the pawl is then located in the recess of the button so that the driving head is pivoted and the first engagement end of the driving head moves over the second engagement end of the pawl to adjust the angle of the driving head relative to the handle, the second engagement end of the pawl is engaged with the first engagement end again when releasing the button;

wherein a second guide surface is connected between the recess and the second contact surface;

wherein the second guide surface is a curved and convex surface.

12. The hand tool as claimed in claim 11, wherein the first connection end includes two protrusions and a space is defined between the two protrusions, the second connection end of the driving head is pivotably received in the space.

13. The hand tool as claimed in claim 11, wherein a first guide surface is connected to the first contact surface of the pawl.

* * * * *